United States Patent [19]

Miles

[11] Patent Number: 4,941,327

[45] Date of Patent: Jul. 17, 1990

[54] COMPACT FOOD PACKAGE DISPLAY REFRIGERATOR

[75] Inventor: Milton C. Miles, Aurora, Ohio

[73] Assignee: FreshNes Foods Corporation, Solon, Ohio

[21] Appl. No.: 383,704

[22] Filed: Jul. 24, 1989

[51] Int. Cl.[5] ..... A47F 3/04

[52] U.S. Cl. ..... 62/246; 62/250; 62/253; 62/458; 221/150 R

[58] Field of Search ..... 62/239, 337, 377, 378, 62/252, 253, 255, 458, 465, 466, 383, 246, 249, 250; 221/150 R

[56] References Cited

U.S. PATENT DOCUMENTS

| | | | |
|---|---|---|---|
| 2,299,347 | 10/1942 | Rifkin | 221/150 R |
| 2,499,089 | 2/1950 | Brill et al. | 62/458 X |
| 2,522,090 | 9/1950 | Brill et al. | 62/458 X |
| 2,693,089 | 11/1954 | Teeter et al. | 62/253 |
| 2,786,337 | 3/1957 | Spring | 62/458 X |
| 3,491,548 | 1/1970 | Christiansen | 62/246 X |

*Primary Examiner*—Lloyd L. King

*Attorney, Agent, or Firm*—Body, Vickers & Daniels

[57] ABSTRACT

A compact retail display refrigerator for displaying refrigerated food packages maintained at super chilled temperature comprises a small cabinet with a refrigerated upper compartment containing a row array of package guideways formed of a plurality of vertically extending guide pins upstanding from a perforated base support plate. Self acting spring loaded lift devices mounted within the guideways support stacks of food packages therein and urge them upwardly step-by-step to automatically locate the existing topmost package in each stack at a predetermined selection level. Refrigerating mechanism located within a lower compartment of the cabinet includes a pair of cooling coils having alternately operating cooling and defrosting cycles and mounted in a bottom cooling chamber portion of the cabinet, and an electric fan forces the cooled air from the cooling chamber upwardly through a vertical duct at the back of the cabinet and having a forwardly directed side outlet opening at its top end for directing a stream of the chilled air forwardly across the top of the row array of package stacks and downwardly therebetween and through the perforated base support plate back into the cooling chamber.

17 Claims, 3 Drawing Sheets

COMPACT FOOD PACKAGE DISPLAY REFRIGERATOR

The present invention relates to food package display refrigerators and, more particularly, to a compact self-standing retail display refrigerator for maintaining stacks of food packages at a predetermined selection or display level therein at a super chilled temperature.

BACKGROUND OF THE INVENTION

Packaged chilled ready-to-eat food servings such as tuna salad, pasta and ham, and the like are presently being marketed in food stores such as supermarkets, delicatessens, and dairy stores. To maintain their freshness, such packaged foods desirably should be maintained at super chilled temperatures ranging from about 28° F. to 32° F. Heretofore, the only store display area for such chilled ready-to-eat packaged food servings has been the refrigerated meat counters which ordinarily maintain a temperature of around 28° F. The refrigerated delicatessen cases are maintained at too warm a temperature while the freezer cases are maintained at too cold a temperature.

While the refrigerated meat cases maintain the desirable chill temperature for such packaged ready-to-eat food servings, they are ordinarily located because of their comparatively large size at out-of-the way locations in the supermarket and delicatessens, usually at the rear of such stores, such as is time-consuming to the prospective purchaser desiring to quickly purchase a lunch consisting of such packaged refrigerated ready-to-eat food servings. Moreover, such meat cases must be periodically turned off for cleaning. When this occurs, the packaged ready-to-eat food servings must be removed from the meat case, thereby causing them to become overly warm so that the packaged food loses some of its vitality. For the above reasons, there is a need for a compact portable retail display refrigerator for such packaged ready-to-eat food servings which can be accommodated with minimum space requirement at a location in the front of the store for quick purchase by persons seeking a luncheon purchase, and which will maintain the packaged food servings at the desired super chilled temperatures ranging from about 28° F. to 32° F.

SUMMARY OF THE INVENTION

The present invention contemplates a new and improved compact retail display refrigerator which overcomes all of the above referred to problems and others and provides a compact refrigerator for displaying refrigerated packaged ready-to-eat food servings and maintaining them at desired super chilled temperatures ranging from about 28° F. to 32° F.

Briefly stated, in accordance with the present invention, the refrigerator is comprised of a small compact metal cabinet or outer shell having an open top and comprised of vertically extending front and back walls and a pair of side walls. The cabinet is provided with an inner upper chamber portion constituting the refrigerated storage compartment for the food packages to be displayed and formed by walls spaced slightly from the front, rear and side walls of the cabinet to form narrow channelways therebetween filled with suitable thermal insulation material. A plurality of vertically extending guideways upstanding from a perforated stepped base plate are arranged in an orthogonal row array in the refrigerated compartment for supporting a plurality of vertical stacks of the food packages in spaced apart orthogonal relation for progressive upward step-by-step movement. Self-acting lift devices comprising spring loaded rest platforms for the respective stacks of packages are mounted in the guideways for supporting the package stacks therein in rested position on the lift devices and continuously urging them upwardly to locate the existing topmost package in each stack at an exposed predetermined selection or display level at the open top of the cabinet. Conventional refrigeration mechanism mounted within a bottom chamber portion of the cabinet produces chilled air at the desired super chilled temperature ranging between about 28° F. to 32° F., and the chilled air is forced by an electric fan upwardly through a vertical air duct at the back of the cabinet at such velocity as to discharge from an air outlet opening at the top of the air duct a forwardly directed stream of air passing over the tops of the array of food package stacks in the guideways and downwardly therebetween to maintain the packages at the desired super chilled temperatures.

In accordance with another aspect of the invention, the vertical guideways for the stacks of food packages are formed by vertically extending spaced guide pins upstanding from the perforated base support plate of the refrigerator for exposing all of the food packages in the stacks to the chilled air passing downwardly therebetween in order to provide a more uniform air flow around the respective stacks of food packages in order to maintain them at a uniform chilled temperature within the desired range thereof.

In accordance with still another aspect of the invention, the refrigeration mechanism located within the bottom chamber portion of the cabinet includes two separate cooling coils each having a cooling cycle and a defrosting cycle, the cooling cycle of each one of the cooling coils always operating during the defrosting cycle of the other one of the cooling coils in order to maintain a constant cooling of the air and a constant super chilled temperature within the upper refrigerated chamber portion of the refrigerator.

According to a further aspect of the invention, the vertical guideways for the food package stacks are arrayed orthogonally in a plurality of front to back rows and a plurality of cross rows, and the lift devices for the package stacks are adapted to position the existing topmost packages in respective rows of the cross rows of guideways at the same selection level.

According to a still further aspect of the invention, the lift devices for the package stacks are adapted to position the existing topmost packages in each of the front-to-back rows of the guideways at the same progressively higher selection level corresponding approximately to the thickness of the packages and to support the packages in all of the guideways in the same forwardly tilted position, and the air duct is provided with louvers in the air outlet opening thereof for directing the chilled air from the top of the air duct in a downwardly angled forward stream across the tops of the row array of stacks of forwardly tilted packages and downwardly therebetween.

It is a principal object of the invention to provide a compact open top retail display refrigerator for chilled packaged food servings which is capable of maintaining the food packages at substantially uniform super chilled temperatures.

Another object of the invention is to provide a retail display refrigerator of the above referred to type which is adapted to support a plurality of stacks of food packages in an orthogonal row array with the existing topmost package of each stack maintained at a predetermined selection or display level to maintain the exposed top surface of the row array package display at a constant shape so that proper chilled air flow over the tops of the package stacks and downwardly alongside the package stacks is more easily maintained and the food packages thereby more uniformly protected at proper super chilled temperatures.

Still another object of the invention is to provide a retail display refrigerator of the above referred to type which is adapted to support a plurality of stacks of food packages in an orthogonal row array comprised of a plurality of front-to-back rows and a plurality of cross rows, with the exposed topmost package in each of the cross rows positioned at the same selection level and the existing topmost packages in each of the front-to-back rows positioned at the same progressively higher selection level corresponding approximately to the thickness of the packages, and with all of the packages in all of the stacks thereof positioned in the same forwardly tilted position.

A further object of the invention is to provide a retail display refrigerator of the above referred to type, the refrigerating mechanism of which includes a pair of cooling coils alternately operating on their cooling and defrosting cycles so that the cooling cycle of each one of the cooling coils will always be operating during the defrosting cycle of the other one of the coiling coils.

A still further object of the invention is to provide a retail display refrigerator of the above referred to type in which the stacks of food packages are supported in separated relation by vertically extending guide pins to provide a more uniform flow of chilled air downwardly around the package stacks to maintain the packages at a uniform super chilled temperature.

Further objects and advantages of the invention will be apparent from the following description of a preferred species thereof and from the accompanying drawings.

DESCRIPTION OF THE PREFERRED EMBODIMENT

Figure 1:
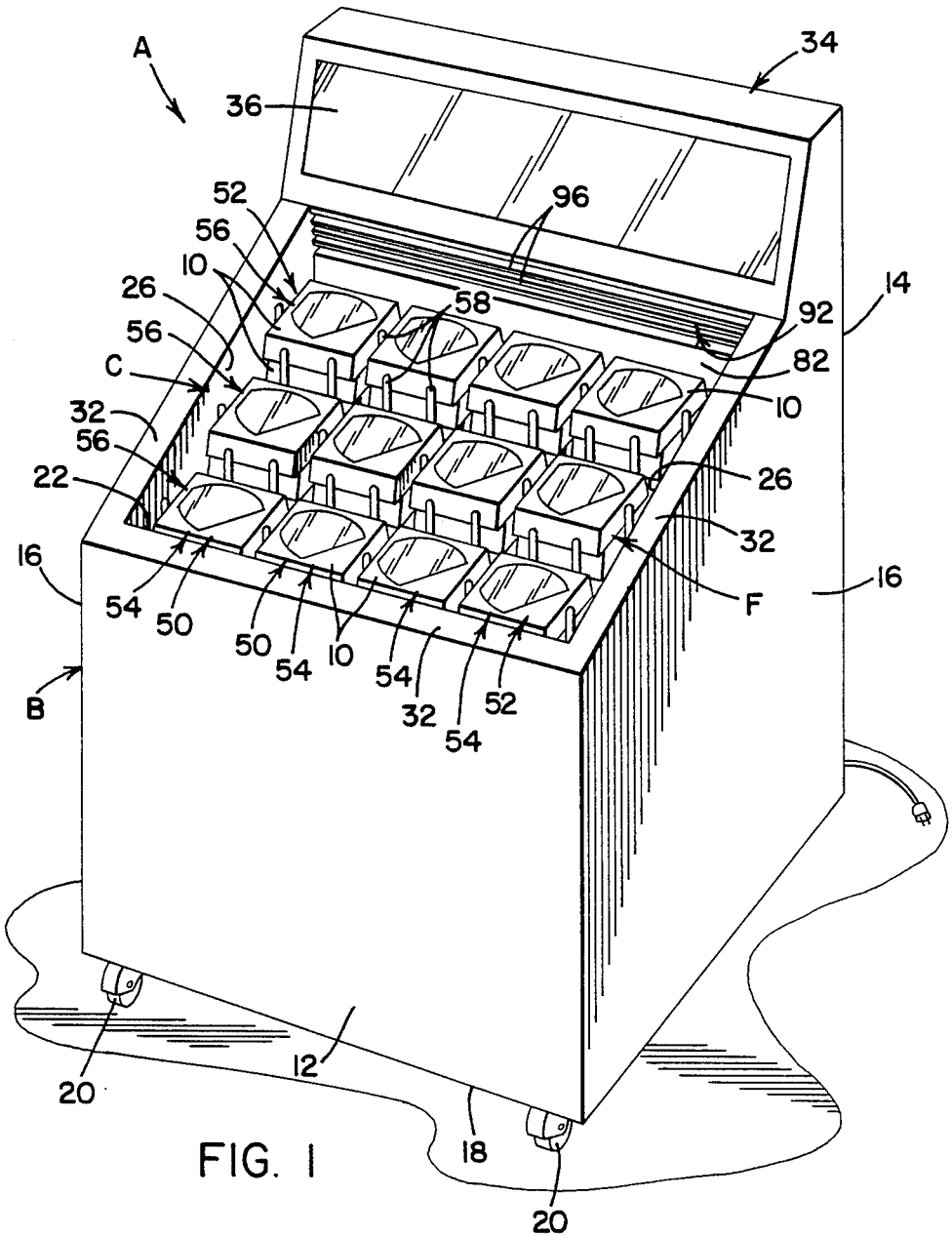
FIG. 1 is a perspective view of a compact retail display refrigerator according to the invention for displaying packaged food servings at super chilled temperatures.
Figure 2:
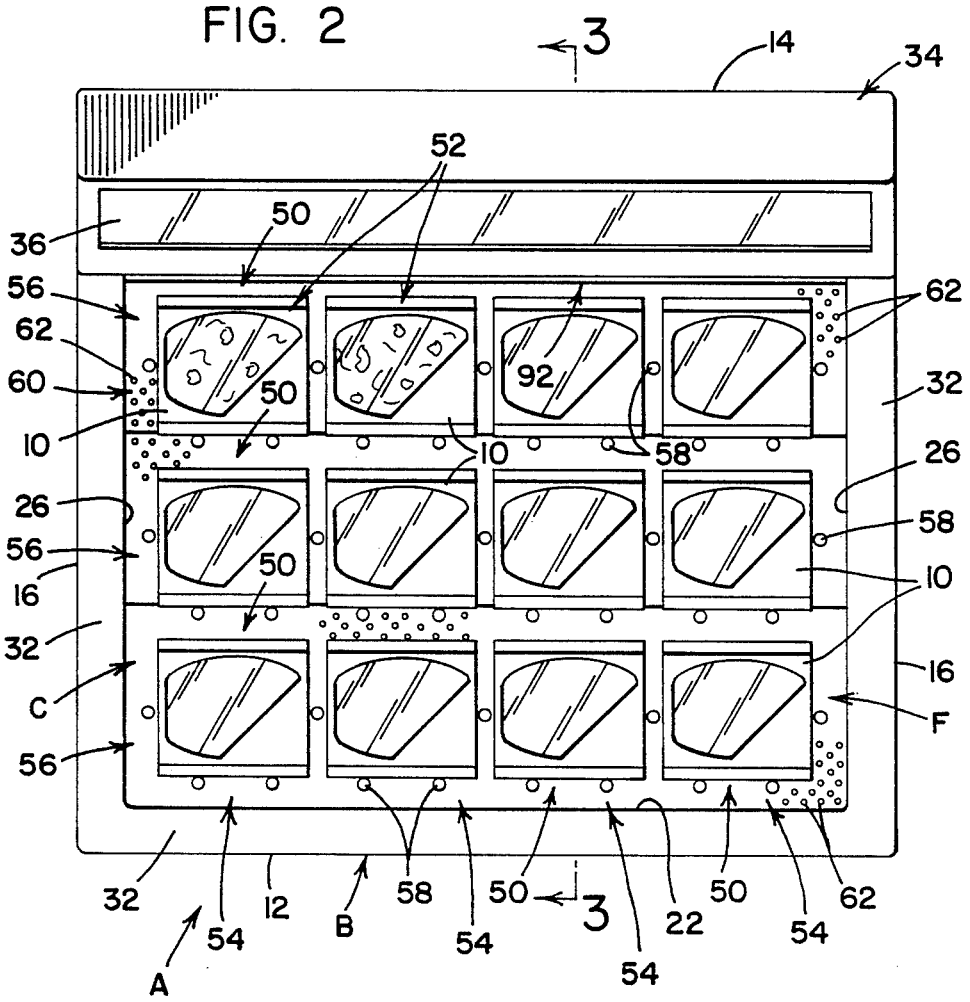
FIG. 2 is a plan view of the display refrigerator shown in FIG. 1.

Referring now to the drawings wherein the showings are for the purposes of illustrating a preferred embodiment of the invention only and not for the purposes of limiting same, the figures show a compact retail display refrigerator A comprised of an upstanding cabinet or metal outer shell B having an upper, open top, refrigeration compartment C for displaying food packages 10 maintained at super chilled temperatures ranging from about 28° F. to 32° F., and a lower compartment D containing a refrigerating mechanism E. The cabinet A is comprised of vertically extending metal sheet front, rear and side walls 12, 14, and 16, respectively, and a bottom wall 18, and is made of comparatively small size so as to occupy little floor space at the front of food stores and delicatessens. For this purpose, the cabinet B may suitably be made around forty inches in width, thirty-four inches in depth, and thirty-two inches in front wall 12 height and fifty-three inches in rear wall 14 height. The cabinet B may be provided at its underside with casters 20 mounted on the bottom wall 18 to impart mobile portability to the refrigerator A.

Figure 3:
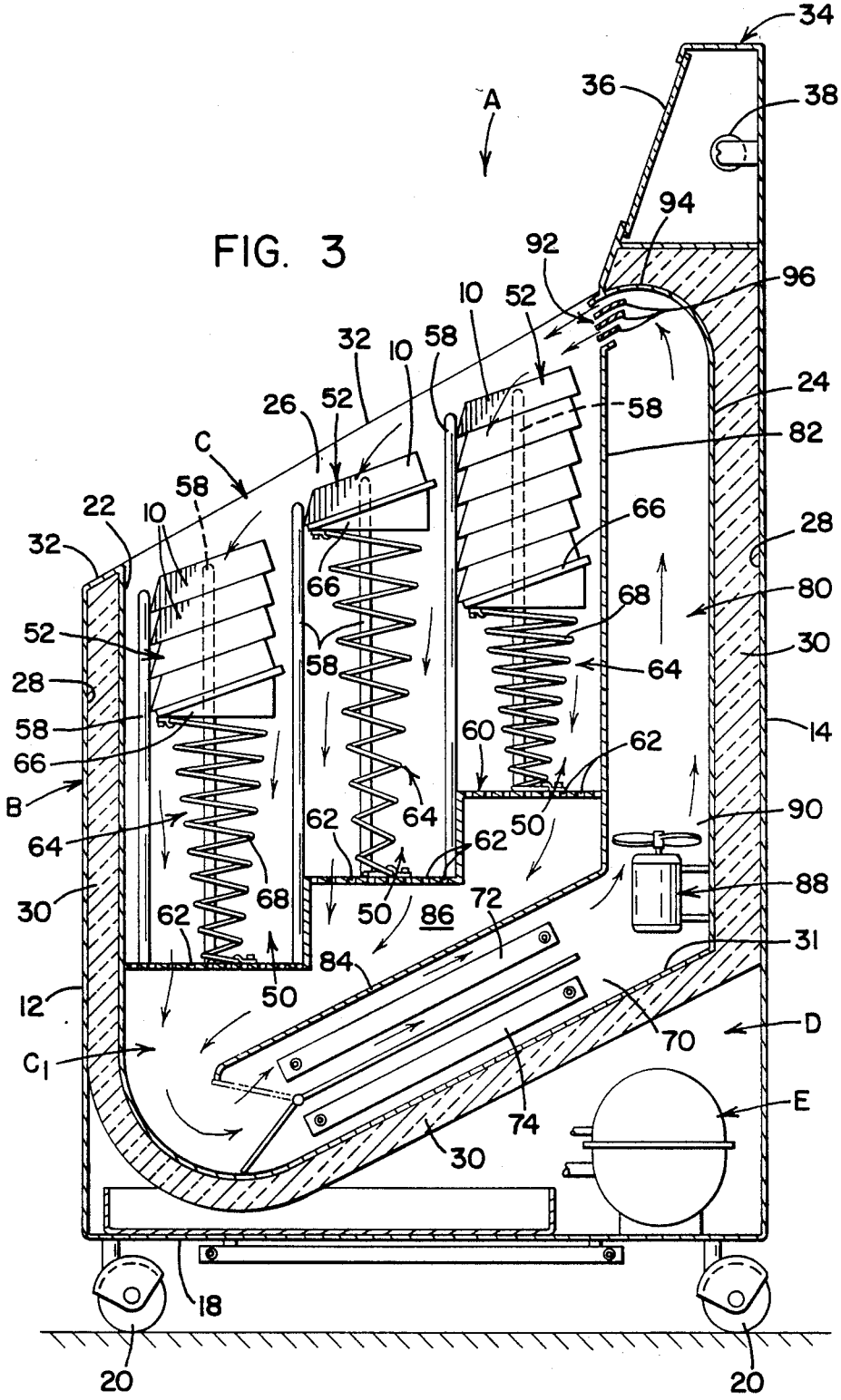
FIG. 3 is a vertical sectional view of the refrigerator taken on the line 3—3 of FIG. 2.

The upper refrigeration compartment C is formed by vertical front, rear, and side walls 22, 24 and 26, respectively, supported on and spaced slightly from the front, rear, and side walls 12, 14 and 16 of the cabinet B to form narrow channelways 28 therebetween which are filled with suitable thermal insulation material 30 such as commonly employed for thermal insulation purposes in conventional household refrigerators. The refrigeration compartment is further formed by a rearwardly inclined bottom wall 31 exteriorly lined with a layer of the thermal insulation material 30. The front and side walls 12 and 16 of the cabinet B are joined at their top ends with the top ends of the front and side walls 22 and 26 of the upper refrigeration compartment C, as indicated at 32 in FIG. 1, to close off the channelways 28 therebetween at their top ends. Upstanding from the top of the cabinet B at the back end thereof is a small horizontally elongated housing portion 34 extending across substantially the full width of the cabinet and provided with a vertical or slightly backwardly tilted front display panel portion 36 for carrying printed matter or other signage such as that advertising the products on display in the refrigerator A. The front display panel portion 36 may be of light transmissive or translucent character and back-lighted by a suitable electric light source such as a tubular fluorescent lamp 38 mounted inside the housing 34. As shown in FIG. 3, the top edges 32 of the respective joined together top edges of the cabinet side walls 16 and refrigerated compartment side walls 26 are inclined upwardly and backwardly at a small angle of around 30° or so to the horizontal.

The upper refrigeration compartment C of the cabinet A contains a plurality of vertically extending side-by-side guideways 50 (FIG. 3) arranged in a suitable orthogonal row array F thereof for supporting a plurality of stacks 52 of the food packages 10 for progressive upward step-by-step movement therein. In the particular case illustrated, the array F of guideways 50 are arranged in four front-to-back rows 54 and three cross rows 56 extending across the width of the refrigerator A. The guideways 50 are each comprised of a plurality of vertically extending elongated guide pins 58 upstanding in spaced apart relation from a multiply perforated rearwardly and upwardly stepped base support plate 60 mounted on the front and side walls 22 and 26 of the inner refrigerated chamber portion C of the cabinet B with its individual steps corresponding to the respective cross rows 56 of guideways 50. As shown, the stepped base support plate 60 is mounted in the cabinet at a level somewhat closer to the bottom of the cabinet than to the top thereof. The base support plate 60 separates the upper refrigerated chamber portion C of the cabinet from the lower portion $C_1$ thereof, and is provided with a multiplicity of perforations 62 for permitting the return of the cooling air from the refrigerated upper chamber portion C down into the lower chamber portion $C_1$ for recooling purposes therein.

The guide pins 58 forming each of the guideways 50 are located in proper spaced relation to each other to accommodate a stack 52 of the food packages 10 therein for free upward movement in the guideway. Thus in the particular case illustrated wherein the food packages 10 are of rectangular contour, the guide pins 58 forming each of the guideways 50 are spaced apart in the same rectangular relation to each other as the rectangular contour of the food packages 10 to be stacked therein.

Self-acting spring loaded lift devices 64 are mounted in the respective guideways 50 for supporting the stacks 52 of food packages 10 therein in rested position on the lift devices 64 and continuously urging them upwardly in their respective guideways to a predetermined limiting position therein in which the existing topmost package 10 in each stack 52 is always located at approximately the same predetermined selection or display level at the top of the respective guideway. The lift devices 64 are adapted to position the existing topmost packages 10 in respective ones of the package stacks 52 comprising the row array thereof always at the same respective selection or display level so that all of these existing topmost packages 10 in the row array will be located generally in a flat plane tilted upwardly and backwardly at approximately the same or slightly less angle of inclination of around 30° to the horizontal of the joined together top edges 32 of the side walls 16 and 26 of the cabinet B and upper refrigeration compartment C. To this end, the lift devices 64 in the guideways 50 are adapted to always position the existing topmost packages 10 in respective ones of the cross rows 56 thereof at the same selection level, and to always position the existing topmost packages 10 in respective ones of the front-to-back rows 54 thereof at the same progressively higher selection level corresponding approximately to the thickness of the packages 10. In addition, the lift devices 64 are adapted to support the packages 10 in all of the guideways in the same forwardly tilted position therein at an angle of around 20° or so, as shown in FIG. 3.

The self acting spring loaded lift devices 64 each comprise a wedge shaped platform 66 on which the stacks 52 of food packages 10 rest in the aforementioned forwardly tilted position, and an underlying conical compression coil spring 68 of appreciable compressive throw or deflection which is compressed between the platform 66 and the perforated base support plate 60. The platform 66 is fixedly mounted on the upper end of the coil spring 68 and supports the stack 52 of food packages 10 in the guideway 50 in the aforementioned forwardly tilted position therein when the packages are rested in a flatwise position on the platform. Because of the appreciable throw or deflection characteristic of the coil springs 68, a sizable number, e.g. five or six, of the comparatively thin (approximately 1⅝ inch thickness) food packages 10 can be stacked in each of the guideways 50. The coil springs 68 are designed to support the stacks 52 of food packages 10 on the lift devices 64 much in the same manner as salad plates are in cafeteria and restaurant salad bars, so that the existing topmost package in the stack is always located at the same selected display level at the top of the respective guideway 50, in position for easy manual removal therefrom by a prospective purchaser. To this end the springs 68 are of conical configuration and of circular wire cross-section, and should be designed to have a constant deflection for a given package 10 weight load so as to have a spring coefficient, i.e., load (lbs.) deflection (inches) of approximately 0.29, or a resilience, i.e., load (lbs.) x deflection (inches) /2, of approximately 0.38 inch lbs. in the particular case illustrated for food packages 10 of approximately 7½ oz. weight and approximately 1⅝ inches thickness or height. The springs are illustrated as conical in configuration to control the spring constant during deflection. This technology is known and the shape can be changed to obtain the desired operation of presenting successive packages 10 at the same upper position as packages are removed from the stacks 52.

A refrigeration mechanism or system schematically illustrated at E is mounted in the lower compartment D of the cabinet B. The refrigeration system E may be of conventional type such as is commonly employed in household refrigerators and, in the particular case illustrated, includes two separate coiling coils 72 and 74 mounted within the bottom cooling chamber portion 70 of the refrigerated compartment C and each having a cooling cycle and a defrosting cycle. The cooling cycle of each one of the cooling coils 72, 74 always operates during the defrosting cycle of the other one thereof in order to maintain a constant super chilled cooling air temperature ranging between about 28° F. to 32° F. within the refrigerated package containing upper compartment C of the refrigerator A.

The cabinet B is provided at its back end with a vertically extending air duct 80 formed by the back wall 24 and side walls 26 of the refrigerated upper compartment C and by a vertically extending forward wall 82 spaced from and parallel to the vertical back wall 24. A divider panel 84 extends in a forwardly and downwardly angled direction from the lower end of the forward wall 82 of the air duct 80 but terminates short of the front wall 22 of the upper refrigerated compartment C to divide the lower compartment $C_1$ thereof into an upper return air chamber portion 86 and the bottom cooling chamber portion 70 in communication therewith, and containing the cooling coils 72, 74. After being cooled by the cooling coils 72, 74 to the aforementioned super chilled temperature range in the cooling chamber portion 70, the super chilled air is forced upwardly through the air duct 80 by an air circulating electric fan 88 located within the cooling chamber portion 70 adjacent the open bottom end 90 of the air duct 80. The super chilled air passing upwardly through the air duct 80 is discharged forwardly from the top end thereof through a forwardly directed horizontal slot-shaped side outlet opening 92 therein formed in part by an overhanging concave top deflector 94 which directs the chilled air laterally outward through the outlet opening 92. A plurality of horizontally extending, downwardly tilted, slat-shaped louvers 96 are disposed within the air outlet opening 92 for directing the chilled air passing out through the outlet opening 92 in a horizontally flattened, downwardly angled, stream across the tops of the row array of package stacks 52 and downwardly therebetween, with minimal loss of the chilled air stream over the front of the cabinet B. This downward passage of the chilled air flow between and around the package stacks 52 is aided by the suction of the air from the return air chamber portion 86 and into the cooling chamber portion 70 of the lower compartment $C_1$ by the electric fan 88. The passage of the stream of super chilled air across the tops of the array of package stacks 52 and downwardly therebetween thus maintains all of the food packages 10 in all the package stacks 52 at the desired super chilled temperature ranging from about 28° F. to about 32° F.

Whenever one or more of the existing topmost food packages 10 in any of the package stacks 52 is removed from the associated guideway 50, the self-acting lift device 64 in that particular guideway then immediately operates to raise the remaining stack of packages 10 therein a distance to position the then existing topmost package in that particular guideway 50 again at the predetermined selection or display level, thus maintaining the surface of the displayed packages in the array thereof in a constant shape at all times so that proper chilled air flow is more easily obtained thereacross and the chilled food packages are more uniformly protected at the desired super chilled temperatures. Also, a better sales display of the food packages 10 is thereby always provided.

The guide pins 58 forming the respective guideways 50 support the package stacks 52 in slightly separated relation to each other to provide vertical passageways therebetween for the downward passage of the super chilled air therethrough. The separation of the stacks 52 of food packages 10 by the elongated guide pins 58 rather than by solid divider walls exposes the packages 10 comprising the various stacks 52 thereof to the super chilled air flowing downwardly through the passageways between the various package stacks 52, thus maintaining all of the packages 10 in all of the stacks 52 uniformly at the desired super chilled temperatures.

Having thus described the invention, it is claimed:

1. A compact retail display refrigerator for displaying refrigerated, like form, food packages maintained at super chilled temperatures, said refrigerator comprising a small size cabinet having an open top, front and back walls, a pair of side walls, and a bottom wall, said cabinet being provided with an upper inner refrigeration compartment containing a plurality of vertically extending guideways arranged in an orthogonal row array for supporting a plurality of stacks of the food packages in spaced apart orthogonal relation therein for progressive upward step-by-step movement in the guideways, said guideways each comprised of a plurality of vertically extending spaced guide pins upstanding from a perforated base support plate spaced above the said bottom wall of the cabinet to define a lower refrigerated compartment portion therein including a bottom cooling chamber portion, self-acting spring loaded lift devices mounted within the respective said guideways for supporting the said stacks of food packages therein in rested position on said lift devices and continuously urging them upwardly in their respective said guideways to locate the existing topmost package in each stack at an exposed predetermined selection level at the open top of the cabinet, refrigerating mechanism including cooling coil means located within said bottom cooling chamber portion for providing chilled air at the said super chilled temperatures, and chilled air flow creating means including a vertical air duct located at the back of said cabinet and provided with a closed top end and an air circulating electric fan located within said cooling chamber adjacent the open bottom end of said air duct for forcing the said chilled air from said cooling chamber portion upwardly through said air duct to the top of the cabinet and directing a horizontally flattened stream of the chilled air forwardly across the tops of the said row array of package stacks and downwardly therebetween to maintain the individual packages at the said super chilled temperatures.

2. A display refrigerator as defined in claim 1, wherein the said super chilled temperatures range between approximately 28° to 32° F.

3. A display refrigerator as defined in claim 1, wherein the said lift devices each comprise a support platform vertically movable within the respective said guideway and on which the associated package stack rests and compression spring means mounted within said guideway below said platform and compressed against the said platform.

4. A display refrigerator as defined in claim 3, wherein the said compression spring means mounted within each of said guideways comprises a compression coil spring.

5. A display refrigerator as defined in claim 1, wherein the said chilled air duct is provided at its top end with a closed top and with a forwardly directed, horizontally slot-shaped, side outlet opening, and a plurality of horizontally extending slat-like louvers are disposed within said outlet opening for directing the chilled air discharged therefrom in a horizontally flattened stream across the tops of the said row array of package stacks and passing downwardly therebetween.

6. A display refrigerator as defined in claim 1, wherein said guideways are arrayed in a plurality of front to back rows and a plurality of cross rows, and the said lift devices are adapted to position the existing topmost packages in respective ones of the said cross rows of said guideways at the same said selection level.

7. A display refrigerator as defined in claim 6, wherein the said lift devices are adapted to position the existing topmost packages in each of said front-to-back rows of said guideways at the same progressively higher selection level corresponding approximately to the thickness of the packages.

8. A display refrigerator as defined in claim 7, wherein the said lift devices are adapted to support the existing packages in all of the said guideways in the same forwardly tilted position therein.

9. A display refrigerator as defined in claim 7, wherein the said chilled air flow creating means directs the said chilled air from the top of said air duct in a downwardly angled forward stream across the tops of the said row array of package stacks and downwardly therebetween.

10. A display refrigerator as defined in claim 8, wherein the said chilled air flow creating means directs the said chilled air from the top of said air duct in a downwardly angled forward stream across the tops of the said row array of package stacks and downwardly therebetween.

11. A display refrigerator as defined in claim 8, wherein the said chilled air duct is provided at its top end with a forwardly overhanging concave top deflector means defining a forwardly directed horizontal slot-shaped side outlet opening at the top end of the air duct for the chilled air passed therethrough, and a plurality of horizontally extending, downwardly tilted, slat-shaped louvers are disposed within said air outlet opening for directing the chilled air discharged from said air outlet opening in a horizontally flattened downwardly angled stream across the tops of the said row array of package stacks and downwardly therebetween, with minimal loss of the chilled air stream over the front of said cabinet.

12. A display refrigerator as defined in claim 1, wherein the said refrigerating mechanism includes two separate coiling coils each having a cooling cycle and a defrosting cycle, the cooling cycle of each one of said cooling coils always operating during the defrosting cycle of the other one of said cooling coils.

13. A display refrigerator as defined in claim 1, wherein the said cabinet is provided with an inner upper chamber portion containing the said guideways and air duct and formed by walls spaced slightly from the said front and rear and side walls of the cabinet to form narrow channelways therebetween filled with thermal insulation material.

14. A display refrigerator as defined in claim 13, wherein the said air duct includes a vertically extending forward wall and the vertically extending back wall of said upper chamber portion, and a divider panel is located in the said lower refrigerated compartment portion extending in a forwardly and downwardly angled direction from the lower end of the said forward wall of said chilled air duct but terminating short of said front wall of said lower compartment portion to divide the said compartment portion thereof into an upper return air chamber portion and the said bottom cooling chamber portion in communication with each other.

15. A display refrigerator as defined in claim 1, wherein the said cabinet is provided at its underside with casters mounted on the said bottom wall of the cabinet to impart mobile portability thereto.

16. A display refrigerator as defined in claim 3, wherein the said compression spring means mounted within each of said guideways comprises a conical compression coil spring of circular wire cross-section and having a load to deflection ratio of around 0.29.

17. A display refrigerator as defined in claim 3, wherein the said compression spring means mounted within each of said guideways comprises a conical compression coil spring of circular wire cross-section and having a resilience of around 0.38 inch lbs.

* * * * *